US009671799B2

(12) United States Patent
Krueger

(10) Patent No.: US 9,671,799 B2
(45) Date of Patent: Jun. 6, 2017

(54) SYSTEM AND METHOD FOR A POWER SUPPLY CONTROLLER

(71) Applicant: Infineon Technologies Austria AG, Villach (AT)

(72) Inventor: Martin Krueger, Munich (DE)

(73) Assignee: Infineon Technologies Austria AG, Villach (AT)

( * ) Notice: Subject to any disclaimer, the term of this patent is extended or adjusted under 35 U.S.C. 154(b) by 773 days.

(21) Appl. No.: 13/758,669

(22) Filed: Feb. 4, 2013

(65) Prior Publication Data

US 2014/0217998 A1 Aug. 7, 2014

(51) Int. Cl.
*G05F 1/46* (2006.01)

(52) U.S. Cl.
CPC ..... *G05F 1/46* (2013.01)

(58) Field of Classification Search
CPC .. G05F 1/46; G05F 1/461; G05F 1/56–1/565; G05F 1/575; H02M 2001/0045
USPC ..... 323/265, 271, 273–275
See application file for complete search history.

(56) References Cited

U.S. PATENT DOCUMENTS 5,864,225 A * 1/1999 Bryson ..... G05F 1/575 307/18
6,984,969 B1 * 1/2006 Liu ..... H02M 3/158 323/280
7,880,456 B2 2/2011 Falvey et al.
2002/0057080 A1 5/2002 Telefus et al.
2006/0261794 A1 11/2006 May
2007/0184793 A1 * 8/2007 Drogi ..... H03F 1/0205 455/127.1
2007/0210777 A1 9/2007 Cervera et al.
2008/0252277 A1 10/2008 Sase et al.
2009/0316454 A1 * 12/2009 Colbeck ..... H02M 1/4225 363/89
2013/0162233 A1 * 6/2013 Marty ..... H02M 3/158 323/274
2013/0214858 A1 * 8/2013 Tournatory ..... H02M 3/156 330/127
2014/0035650 A1 * 2/2014 Zerbe ..... H03L 7/06 327/299

FOREIGN PATENT DOCUMENTS

CN 1914575 A 2/2007

OTHER PUBLICATIONS

Agostinelli, M. et al., "Design of Energy-Efficient Switch-Mode DC DC Converters for Mobile Applications," Infineon Technologies Austria AG, Alpen-Adraia Universitat, Sep. 2011, 1 pg.

(Continued)

*Primary Examiner* — Adolf Berhane
(74) *Attorney, Agent, or Firm* — Slater Matsil, LLP

(57) ABSTRACT

In accordance with an embodiment, a power supply controller includes an error signal input configured to be coupled to a sensing node of a power supply, a control output configured to be coupled to a switch control circuit, and a control circuit having an input coupled to the error signal input. The control circuit is configured to provide a first variable limit signal if the error signal input is in a first range, and to adjust the first variable limit signal according to the error signal input.

35 Claims, 6 Drawing Sheets

(56) References Cited

OTHER PUBLICATIONS

Agostinelli, M. et al., "Fixed-frequency Pseudo Sliding Mode Control for a Buck-Boost DC-DC Converter in Mobile Applications: A Comparison with a Linear PID Controller," 2011 IEEE International Symposium on Circuits and Systems (ISCAS), May 15-18, 2011, pp. 1604-1607.
Hong Suh, Il et al., "A Design and Experiment of Speed Controller with Pi-Plus Bang-Bang Action for a DC Servomotor with Transistorized PWM Drives," IEEE Transactions on Industrial Electronics, vol. IE-31, No. 4, Nov. 1984, 8 pgs. 338-345.
Infineon Technologies Co., "ICE2QS03G; PWM Quasi-Resonant Controller," Datasheet, Version 2.1, Feb. 5, 2010, 19 pgs.
Lee, E. et al., Bang-Bang Impact Control Using Hybrid Impedance/Time-Delay Control, IEEE/ASME Transactions on Mechatronics, vol. 8, No. 2, Jun. 2003, pp. 272-277.
Schoeman, R.M. "Embedded PI-Bang-Bang Curing Oven Controller," IEEE Africon 2011, Sep. 13-15, 2011, pp. 1-5.

* cited by examiner

SYSTEM AND METHOD FOR A POWER SUPPLY CONTROLLER

TECHNICAL FIELD

This invention relates generally to semiconductor circuits and methods, and more particularly to a system and a method for a power supply controller.

BACKGROUND

Power supply systems are pervasive in many electronic applications from computers to automobiles. Generally, voltages within a power supply system are produced by performing a DC/DC, a DC/AC, and/or an AC/DC conversion by operating a switch loaded with an inductor or transformer. DC-DC converters, such as buck converters, are used in systems that use multiple power supplies. For example, in an automotive system, a microcontroller that nominally operates at a 5V power supply voltage may use a switched-mode power supply, such as a buck converter to produce a local 5V power supply from the 12V car battery. Such a power supply may be operated by driving an inductor using a high-side switching transistor coupled to a DC power supply. The output voltage of the power supply is controlled by varying the pulse-width of the time during which the switching transistor is in a conductive state.

In many applications, switched mode power converters supply a load with a constant voltage. In some systems, the power converter is configured to its operation when the input voltage, the load current or any other related parameter changes in a way that keeps the output voltage within a given limit. For example, load or line transients may require a fast reaction time. This task may be addressed by a voltage controller that measures the output voltage and adapts control quantities like peak current, switching frequency, duty cycle, or on time; so that the measured output voltage gets close to the desired output voltage.

Responding quickly to a voltage transient, however, may pose difficulties when the power supply is loaded with a large capacitive load. In such cases, a line transient may only affect a small change in the output voltage of the power converter. As such, linear controllers with high loop-gains or sensitive non-linear controllers may be employed to respond to such transients. High loop-gains may and sensitive controllers, however, may increase the risk of unstable operation and slow settling times.

SUMMARY OF THE INVENTION

In accordance with an embodiment, a power supply controller includes an error signal input configured to be coupled to a sensing node of a power supply, a control output configured to be coupled to a switch control circuit, and a control circuit having an input coupled to the error signal input. The control circuit is configured to provide a first variable limit signal if the error signal input is in a first range, and to adjust the first variable limit signal according to the error signal input

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to embodiments in a specific context, namely switched mode power supply. The invention may be applied, however, to other types of circuits and systems, for example, other types of power supplies, power factor converters (PFC), as well as general control and tracking systems.

In an embodiment, a bang-bang controller is operated in parallel with a linear controller. During operation, the linear controller is continually operated while the limits of the bang-bang controller are adjusted to converge to the output of the linear controller. In the case of a large transient, the bang-bang controller initiates operation and quickly reacts to the transient. As the control loop settles, the output of the bang-bang controller approaches the output of the linear controller. Once the error signal is within a predetermined range of the output of the linear controller, operation is switched over from the bang-bang controller to the linear controller. Because the error is limited when linear operation commences, and because the states of the linear controller are already initialized, a smooth handoff to linear operation may be achieved in some embodiments.

Figure 1:
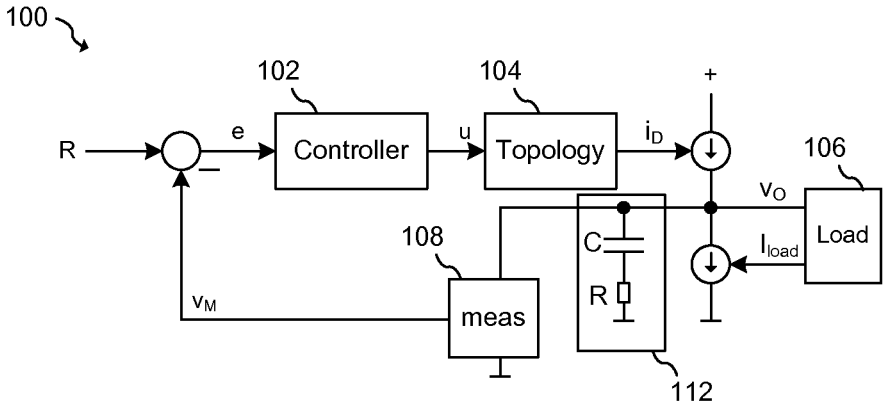
FIG. 1 illustrates an equivalent control diagram of a power supply.

Practical switched mode power converters may be implemented using a switching network made of such components as switching transistors, diodes, inductors, transformers, and in some cases capacitors. From a system point of view, however, a switched mode power supply may be represented as a block diagram as system 100 diagram shown in FIG. 1. System 100 has controller 102 that represents the controller of the power supply. Topology 104 represents the physical circuitry of the power supply including switches, inductors, diodes, and the like; load 106 represents the load seen by the power supply. The power supply topology represented by block 104 may be a boost, buck-boost, flyback, buck, or any other topology. In some topologies, such as interleaved/multiphase, resonant, or bridge topologies, several currents may charge output capacitor C at different time. These currents may be represented as one current $i_d$ for the purposes of illustration and analysis. It should be understood that, while the descriptions of embodiments herein may describe the abstract operation of a power supply, embodiments of the present invention may incorporate a wide variety of topologies such as those described above.

Measurement unit 108 represents the measurement circuitry used to measure the output voltage and/or output current of the power supply and impedance 112 represents the unloaded output impedance of the power supply. As such, measurement unit 108 measures output voltage $v_o$ and produces measured voltage signal $v_M$. This measured voltage $v_M$ is compared to reference voltage R, such that the difference between measured voltage $v_M$ and reference voltage R is error signal e. Controller produces control signal u based on error signal e, which is then used by topology 104 to produce output current $i_D$. Current $i_D$ is then output to load 106 to produce output voltage $v_o$.

For purposes of illustration, impedance 112 is represented as output capacitor C coupled in series with parasitic resistance R. The representation of output impedance 112 as a capacitor is particularly relevant in switched mode power supplies because such supplies are commonly loaded with large capacitors to suppress power supply ripple and/or provide enough output capacitor to attenuate transient current spikes. For example, output capacitor C may be made large enough to support continuous supply in case of interrupted line input power (hold-up requirements). The real capacitor includes parasitic resistance R (equivalent series resistance ESR) and inductance (equivalent series inductance ESL). These parasitics may have an impact on the dynamics of the voltage regulation and voltage ripple. However, the average output voltage is mainly dominated by the capacitive part. It should be understood, however, that impedance 112 may also represent an arbitrary impedance in some circumstances.

A large output capacitor C can maintain the output voltage within an allowed tolerance for a certain time when supply current and load current are not the same. For example, if the capacitance of output capacitor C is 1 mF and the current mismatch between $I_{load}$ and $i_d$ is 1 A, output voltage $v_o$ changes by 1 V after 1 ms. While this effect of the output capacitance is beneficial with respect to the ability of the power supply to maintain its output voltage, it may also have the effect of attenuating the signal path used by controller 102 to sense and subsequently correct this current mismatch. In some embodiments, for example in AC/DC boost converters, flyback converters, and some other topologies, sensing the current mismatch via the output voltage may be the only mechanism by which the controller senses such a mismatch. Since the voltage does not change much at the beginning of the load or a line transient, controller 102 may need to react with a strong response to small output voltage deviations to keep the output voltage constant. Such a strong response to small deviations may lead to instability of the control loop. This is especially the case with respect to digital controllers that suffer from limited ADC resolution and processing delays; however, such conditions may also make analog controllers prone to stability and noise sensitivity issues.

Moreover, even when the line and load conditions are not changing, controller 102 may perform other functions in some embodiments. For example, when the power converter is a power factor correction controller (PFC), the input current of the power supply must follow the input voltage. As such, the voltage control loop may operate in a tracking mode that is slower than the current control loop in order to provide a high power factor and low harmonic distortion. In the case of a PFC and power adapters for printers or notebooks, high efficiency and low electromagnetic emission may be specified, especially at given frequency ranges. The switching frequency may be specified not to exceed a given range and a given rate of change to avoid excessive noise, harmonics, subharmonics and emissions. As a result, controller 102 may need to react quickly to line or load transients but may only be able to recognize these transients only by small and slow changes of the output voltage. At the same time, power supply system 100 may be specified to run in a smooth and stable manner under constant line and load conditions.

In an embodiment, linear feedback is combined with bang-bang control. During steady state conditions, the linear feedback control applies. However, in case of a transient condition, such as voltage drop, voltage overshoot, or a restart of the controller (e.g., after shutdown, line interruption, standby mode) a nested bang-bang control is applied. Furthermore, the linear feedback controller continues to track the error signal while the bang-bang control scheme is operation to avoid large transients when the controller transitions from band-bang control to linear control. During operation, the limits or operating points of the bang-bang control scheme are iteratively updated to approach the output of the linear feedback controller. Once the loop error reaches a threshold value, operation is switched over from the bang-bang control scheme over to the linear controller. Because the linear controller has been tracking the error signal during bang-bang operation, and because the bang-bang controller's operating point approaches the output of the linear controller, the resulting transient during the change from bang-bang operation to linear controller operation may be made small.

Figure 2:
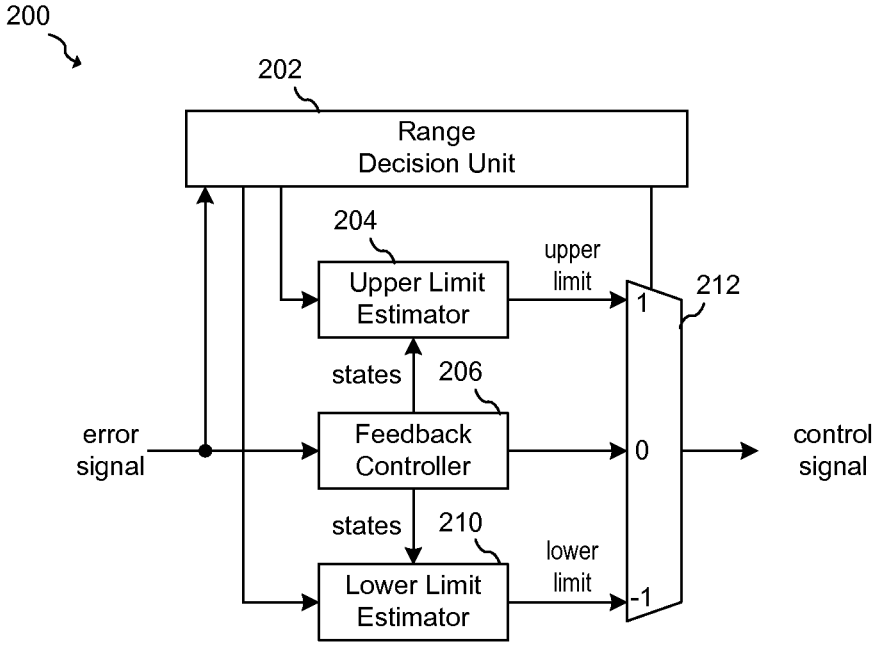
FIG. 2 illustrates an embodiment power supply controller.

FIG. 2 illustrates a block diagram of power supply controller 200 that may be used to implement one embodiment of a control scheme. Power supply controller 200 includes linear feedback controller 206, upper limit estimator 204, lower limit estimator 210, range decision unit 202 and multiplexer 212. During operation, linear feedback controller 206 updates its internal states and outputs one or more of its internal states to upper limit estimator 204 and lower limit estimator 210, which then uses these states to iteratively update its limits. Alternatively, the upper limit estimator 204 and lower limit estimator 210 may use the error signal directly to perform limit estimation. Range decision unit 202 determines whether the output control signal emanates from upper limit estimator 204, feedback controller 206 or lower limit estimator 210 based on the error signal.

In an embodiment, nested bang-bang control scheme, operation begins using a normal bang-bang operation in which upper limit estimator 204 provides an output at an upper limit, and lower limit estimator 210 provides an output at a lower limit. Linear feedback controller 206 may be initialized to a default state or keep a previous state from just before the transient event. As operation proceeds, linear feedback controller 206 is permitted update its internal states based on the loop error while the limit outputs of upper limit estimator 204 and lower limit estimator 210 are iteratively updated to approach an output of linear feedback controller 206. Once the loop error is below a predefined threshold, the operation mode is switched over from the nested bang-bang mode to a linear operation mode by selecting the output of feedback controller 206 via multiplexer 212.

A range decision unit 202 selects between upper limit, lower limit, and linear feedback according to the error signal. At the onset of operation, selection between upper limit and lower limit may correspond to a pure bang-bang control scheme, and selection of linear feedback controller may correspond to a linear feedback control scheme. The range selection unit may be operated, for example, to minimize the error signal.

During the subsequent switching cycles after the onset of operation, the upper limit produced by upper limit estimator 204, the lower limit produced by lower limit estimator 210, and the feedback control signal produced by feedback controller 206 are updated according to the error signal and the states of the feedback controller 206. In some embodiments, update rules may be used to ensure that upper limit and lower limit converge to the output of linear feedback controller 206. After sufficient convergence, as typified, for example, by a low error, the range decision is configured to select unit will select only the linear feedback controller. Besides a low control error, a small difference of the upper limit and the lower limit indicate convergence.

Range decision unit 202 may select operational modes and limits by comparing the error signal to a plurality of thresholds. In one embodiment, the range decision unit 202 has four thresholds $E_{+2}$, $E_{+1}$, $E_{-1}$, and $E_{-2}$ that are arranged such that $E_{+2}$, $E_{+1}$, $E_{-1}$, and $E_{-2}$. It should be understood that the units of the error signal and control signal may vary depending on the particular implementation scheme of controller 200. For example, in a digital control scheme, these values may be represented as binary word, while in an analog implementation; these values may be represented by voltages and/or currents.

In one embodiment, range decision unit 202 may take the following actions described in Table 1. For example, when error signal E has a signal level greater than threshold $E_{+2}$, the output of upper limit estimator 204 is set to a maximum upper limit value and multiplexer 212 is configured to select the output of upper limit estimator 204. This condition may be triggered, for example, if the output of the power converter experiences a voltage drop.

Similarly, when error signal E has a signal level that is less than threshold $E_{-2}$, the output of lower limit estimator 210 is set to a minimum lower limit value and multiplexer 212 is configured to select the output of lower limit estimator 210. This condition may be triggered, for example, when the output of the power converter experiences a voltage overshoot.

TABLE 1

Range Decision Unit Operation

| Range | Control Loop State | Action |
|---|---|---|
| $E > E_{+2}$ | Voltage drop | Set Upper Limit to Maximum Select Upper Limit |
| $E_{+1} < E < E_{+2}$ | Voltage below tracking range | Select Upper Limit |
| $E_{-1} < E < E_{+1}$ | Voltage in tracking range | Select Linear Feedback |
| $E_{-1} < E < E_{-2}$ | Voltage above tracking range | Select Lower Limit |
| $E < E_{-2}$ | Voltage overshoot | Set Lower Limit to Maximum Select Lower Limit |

When error signal E has a signal level between $E_{+1}$ and $E_{+2}$, the output of upper limit estimator 204 is selected via multiplexer 212. The value of the output of upper limit estimator 204, however, is allowed to update iteratively. This condition may apply, for example, when the output voltage of the power supply is below a tracking range. Similarly, when error signal E has a signal level that is between $E_{-1}$ and $E_{-2}$, the output of lower limit estimator 210 is selected via multiplexer 212 and is also allowed to iteratively update. This condition may apply, for example, when the output voltage of the power supply is above a tracking range.

Lastly, when error signal E has a signal level that is between $E_{-1}$ and $E_{-2}$, the output of linear feedback controller 210 is selected, thereby signifying that the output of the power supply is within a voltage tracking range.

In alternative embodiments, overlapping ranges may be defined as well as the adjacent ranges described above. For example, thresholds $E_{-4}$, $E_{-3}$, $E_{-2}$, $E_{-1}$, $E_{+1}$, $E_{+2}$, $E_{+3}$, $E_{+4}$ may be defined such that $E_{-4} \leq E_{-3} \leq E_{-2} \leq E_{-1} < 0 < E_{+1} \leq E_{+2} \leq E_{+3} \leq E_{+4}$. In this example, range decision unit 202 may take the following actions described in Table 2. If E is in several ranges, hysteresis may be applied in which the state that is closest to the last state is taken. For example, if E starts out between $E_{-2}$ and $E_{+2}$, signifying that the voltage is in tracking range, E would need to exceed $E_{+2}$ in order to transition to the voltage below tracking range mode in which the upper limit is selected. In order to transition back to the voltage in tracking range mode, E would need to drop below $E_{+1}$.

TABLE 2

Range Decision Unit Operation with Overlapping Thresholds

| Range | Control Loop State | Action |
|---|---|---|
| $E > E_{+3}$ | Voltage drop | Set Upper Limit to Maximum Select Upper Limit |
| $E_{+1} < E < E_{+4}$ | Voltage below tracking range | Select Upper Limit |
| $E_{-2} < E < E_{+2}$ | Voltage in tracking range | Select Linear Feedback |
| $E_{-1} < E < E_{-4}$ | Voltage above tracking range | Select Lower Limit |
| $E < E_{-3}$ | Voltage overshoot | Set Lower Limit to Maximum Select Lower Limit |

Moreover, range limits used by range decision unit 202 may also be a function of other system parameters like input voltage, temperature, component parameters, and/or load states. Linear feedback controller 206 may be implemented using a basic controller, such as a proportional (P), integral (I), proportional-integral (PI) or proportional-integral-derivative (PID) controller, as well as higher order controllers. In some embodiments, linear feedback controller 206 may be implemented as a state-space based controller with or without observer. Alternatively, any controller that ensures proper steady state behavior may suitable for inclusion in embodiment systems. In many embodiments, the state signals are kept within certain limits, such that nonlinear operation (typically saturation) applies when the limits are approached. For example, the output of linear controller 206 may be configured to saturate at predetermined upper and lower limits.

In an embodiment, upper limit estimator 204 and lower limit estimator 210 are configured to update the upper and lower limits to converge on the output of linear feedback controller 206. The convergence rules for the bang-bang limits $U_{UPR}(t)$ (upper limit) and $U_{LWR}(t)$ (lower limit) may be set to be:

$$U_{UPR}(t) \geq U_{UPR}(t+\Delta t) \geq U_{LFB}(t); \text{ and}$$

$$U_{LWR}(t) \leq U_{LWR}(t+\Delta t) \leq U_{LFB}(t),$$

where $U_{LFB}(t)$ is the output of the linear feedback controller and $\Delta t$ is the time between updates of the bang-bang limits. In some embodiments, the learning rule for the upper limit and the lower limit may be based on a power estimator, such that the power estimation is based on the states of the linear feedback controller and other available signals. In other embodiments, upper limit estimator 204 and lower limit estimator 210 may update its limits using a feedback structure. In some cases, this feedback structure may be similar to a feedback structure of linear feedback controller 206.

Figure 3:
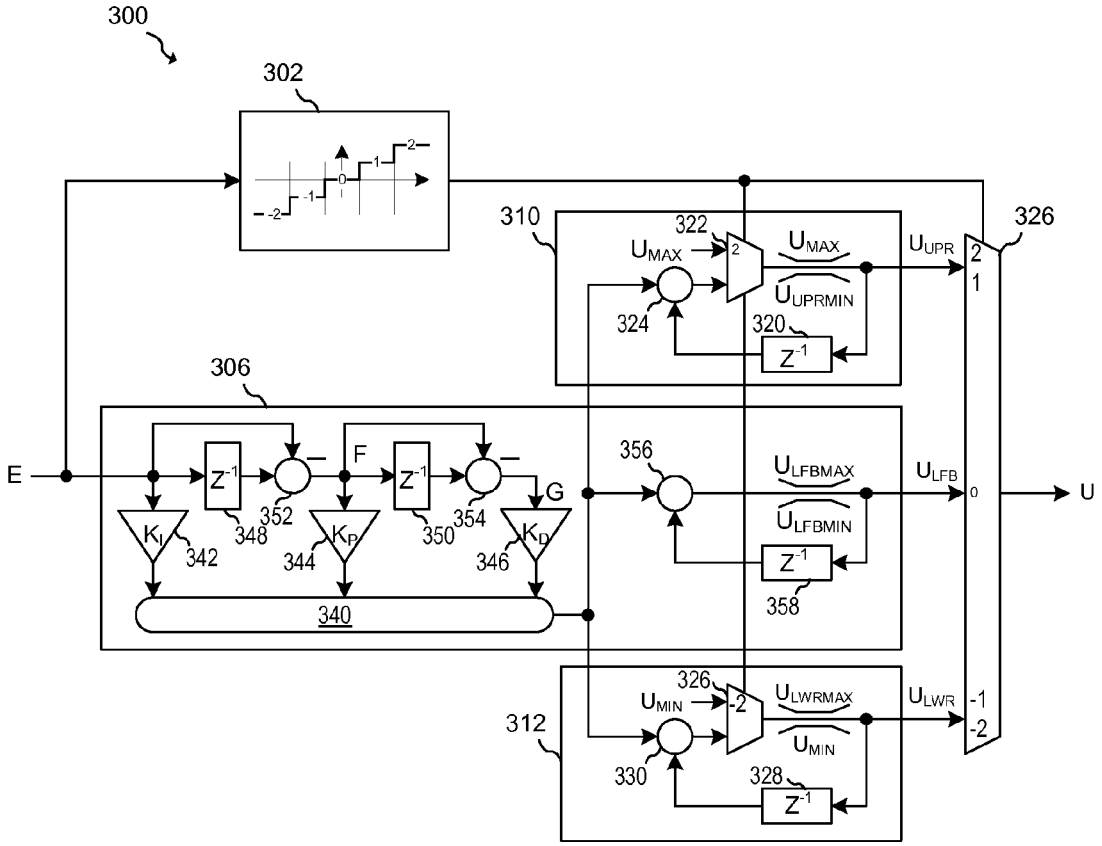
FIG. 3 illustrates another embodiment power supply controller.

FIG. 3 illustrates controller 300 according to an embodiment of the present invention. Controller 300 has range decision unit 302, upper limit estimator 310, linear feedback controller 306, lower limit estimator 312 and multiplexer 326. In an embodiment, range decision unit 302 compares error signal E(t) with thresholds designated by $E_{-2}$, $E_{-1}$, $E_{+1}$ and $E_{+2}$. The decision result is one of the ranges designated with −2, −1, 0, 1, and 2. Similar to the range decision unit depicted in FIG. 2 above, range decision unit causes multiplexer 326 to select output $U_{UPR}$ of upper limit estimator 310 when E(t) is greater than threshold $E_{+1}$; output $U_{LWR}$ of lower limit estimator 312 when E(t) is less than threshold $E_{-1}$; and output $U_{LFB}(t)$ of linear feedback controller 306 when E(t) is between thresholds $E_{-1}$ and $E_{+1}$. In addition, range decision unit 302 causes upper limit estimator 310 to reset its upper threshold to maximum threshold $U_{MAX}$ when E(t) is greater than threshold $E_{+2}$, and causes lower limit estimator 312 to reset its lower threshold to $U_{MIN}$ when E(t) is less than threshold $E_{-2}$. As mentioned above, the actual values of thresholds $E_{-2}$, $E_{-1}$, $E_{+1}$ and $E_{+2}$ are dependent on the physical implementation of controller 300, as well as the specifications and requirements of the system in which controller 300 is disposed. Alternatively, the modes determined by range decision unit 302 may be defined with respect to ranges in place of, or addition to, being defined by thresholds. These ranges may also be overlapping and/or hysteresis may be applied to the determination of these ranges.

In an embodiment, linear feedback controller 306 may be implemented using, for example, a PI or a PID controller. In one example, the PID controller may be implemented using the following continuous time filter:

$$X(t)=K_I E(t)+K_P dE(t)/dt+K_D d^2E(t)/dt^2$$

$$U_{LFB}(t)=\int X(t)dt,$$

where X(t) is an intermediate filtered error value, $U_{LFB}(t)$ is the output of the linear controller, $K_I$ is an integral constant, $K_P$ is a proportional constant, and $K_D$ is a derivative constant. To implement a PI controller, $K_D$ may be set to zero. Saturation may be further applied to the integrator such that:

$$U_{LFB}(t)=\max\{\min\{\int X(t)dt;U_{LFBMAX}\};U_{LFBMIN}\};$$

where $U_{LFBMAX}$ is a maximum saturation level and $U_{LFBMIN}$ is a minimum saturation level.

In another example, the PID controller may be implemented using the following discrete time filter:

$$F[n]=E[n]-E[n-1]$$

$$G[n]=F[n]-F[n-1]$$

$$X[n]=K_I E[n]+K_P F[n]+K_D G[n]$$

$$U_{LFB}[n]=U_{LFB}[n-1]+X[n].$$

Saturation may be further applied to the integrator such that:

$$U_{LFB}[n]=\max\{\min\{U_{LFB}[n-1]+X[n];U_{LFBMAX}\};U_{LFBMIN}\}.$$

It should be understood that, in alternative embodiments, other filters other than the ones shown above may also be used.

In an embodiment, upper limit estimator 310 may be updated according to:

$$U_{UPR}[n]=\max\{\min\{U_{UPR}[n-1]+X[n];U_{UPRMAX}\};U_{UPRMIN}\},$$

where $U_{UPR}[n]$ is the output of upper limit estimator 310, $U_{UPRMAX}$ is an upper saturation limit, and $U_{UPRMIN}$ is a lower saturation limit. Similarly, lower limit estimator 312 may be updated according to:

$$U_{LWR}[n]=\max\{\min\{U_{LWR}[n-1]+X[n];U_{LWRMAX}\};U_{LWRMIN}\},$$

where $U_{LWR}[n]$ is the output of lower limit estimator 312, $U_{LWRMAX}$ is a upper saturation limit of lower limit estimator 312, and $U_{LWRMIN}$ is a lower saturation limit of lower limit estimator 312. The limits may be set according to:

$$U_{LFBMIN}=U_{LOWER}\ U_{LFBMAX}=U_{UPPER}$$

$$U_{LWRMIN}=U_{MIN}\ U_{LWRMAX}=U_{LFB}$$

$$U_{UPRMIN}=U_{LFB}\ U_{UPRMAX}=U_{MAX},$$

where $U_{MIN}$ and $U_{MAX}$ are the start values for $U_{LWR}$ and $U_{UPR}$, respectively.

As can be seen by the above equations for $U_{UPR}[n]$ and $U_{LWR}[n]$, the output of upper limit estimator 310 and lower limit estimator 312 is based on X[n], which is an intermediate filtered error value in within linear controller 306. As such, $U_{UPR}[n]$ and $U_{LWR}[n]$ are derived based on error signal E[n]. It should be understood that in embodiments employing a continuous time controller, $U_{UPR}(t)$ and $U_{LWR}(t)$ may follow X(t) according to the differential equation derived from the rules for $U_{UPR}[n]$ and $U_{LWR}[n]$. Alternatively, $U_{UPR}[n]$ and $U_{LWR}[n]$ may be based on sampling X(t).

In an embodiment, upper limit estimator 310 is implemented using an accumulator having delay element 320 and summer 324. Multiplexer 322 may be used to select upper limit $U_{MAX}$, by range detection unit 302, the selection of which effectively resets output $U_{UPR}$ to $U_{MAX}$. Similarly, lower limit estimator 312 is implemented using an accumulator having delay element 328 and summer 330. Multiplexer 326 may be used to select lower limit $U_{MIN}$ by range detection unit 302, the selection of which effectively resets output $U_{LWR}$ to $U_{MIN}$. In alternative embodiments, other equivalent structures may be used for upper limit estimator 310 and lower limit estimator 312.

Linear controller 306 is implemented in two stages for a time discrete implementation. The first stage has delay elements 348 and 350, summing nodes 352 and 354, gain element 342 corresponding to integral gain $K_I$, and gain element 344 corresponding to proportional gain $K_P$, and gain element 346 corresponding to derivative gain $K_D$. The output of gain elements 342, 344 and 346 are summed together at summing node 340 to form intermediate signal X, which is then used by upper limit estimator 310 and lower limit estimator 312 to derive updated limits. Signal X is also passed to and integrator/accumulator made of delay element 358 and summing element 356 to form linear controller output signal $U_{LFB}$. It should be understood that the structure of linear controller 306 depicted in FIG. 3 is only one example of many possible embodiment linear controller topologies. In alternative embodiments, other linear controllers known in the art may be used.

In embodiments, the physical implementation of linear controller 300 may be implemented using a microcontroller, microprocessor, field programmable gate array (FPGA), custom digital logic, and the like. In some embodiments controller 300 may be implemented using a processor using an executable instruction set. Alternatively, controller 300 may be implemented in an analog fashion using, for example, amplifiers and analog filters.

Figure 4:
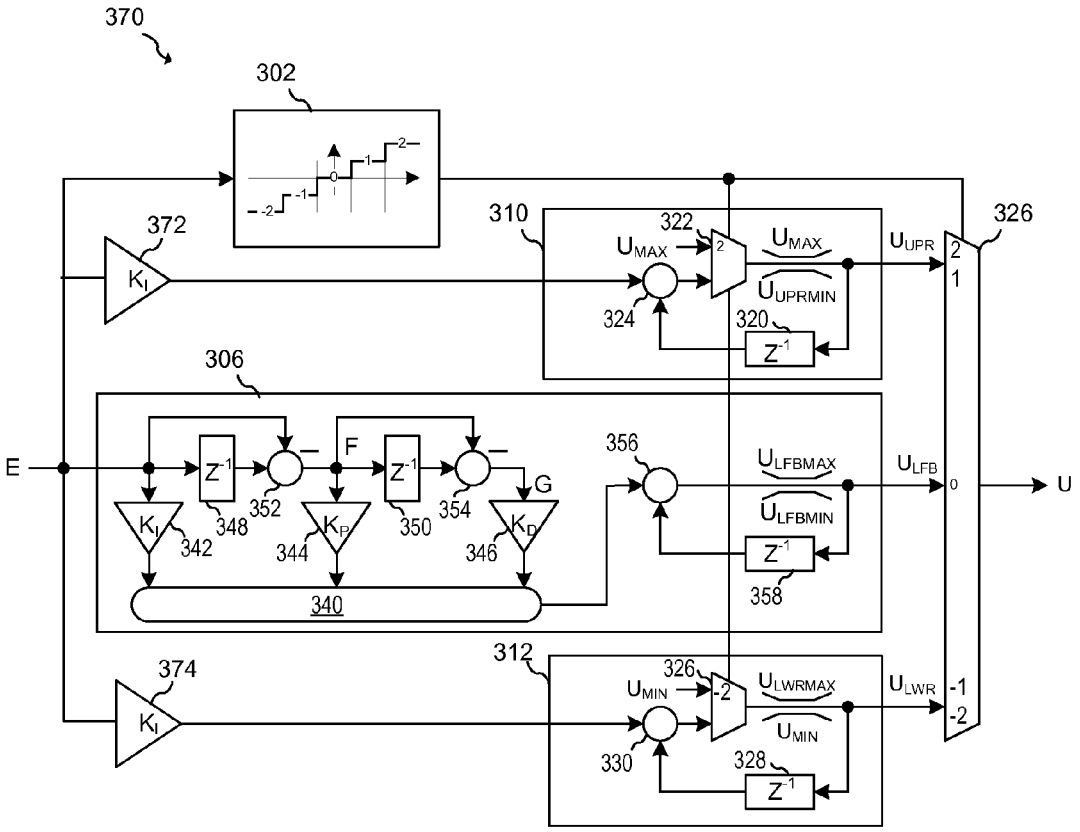
FIG. 4 illustrates a further embodiment power supply controller.

FIG. 4 illustrates embodiment controller 370 according to an alternative embodiment in which upper limit estimator 310 and upper limit estimator 312 are coupled to error signal E via gain blocks 372 and 374 instead of via dynamic elements within linear controller 306. In some embodiments, gain blocks 372 and 374 are scaled to integral gain $K_I$.

Alternatively, other gains and/or scaling factors may be used. By sampling error signal E directly though gain blocks 372 and 374, upper limit estimator 310 and lower limit estimator 312 may converge faster than if sampled via dynamic blocks within linear controller 306 in some embodiments.

In both embodiments shown in FIGS. 3 and 4, a band-selecting filter, for example, a low pass filter may be further placed in the linear feedback controller 306. For example, if the low pass filter is a first order auto-recursive filter, the control filter becomes a first order auto-recursive (PIDT1) filter that approximates the continuous time transfer function GT1($s$)=1/(1+s T1). This control filter may be placed at the input of controller 306 in the embodiments shown in FIGS. 3 and 4. In digital implementations, the control filter may be implemented using digital filtering techniques known in the art, while in analog implementations, this lowpass function may be implemented, using conventional analog filtering techniques. For example, in one embodiment, an additional capacitor may be coupled in parallel to an existing RC network. The band selection filter may be placed before, after, or even inside the PD/PDD$^2$ calculation in linear controller 306. The convergence of upper limit estimator 310 and lower limit estimator 312 may be based on error signal E, a filtered version of error signal E error signal, or any other state of linear feedback filter/controller 306. Moreover, in both embodiments, the convergence can be improved by adding a small offset to the error signal or by forgetting factors in some embodiments. For example, a constant may be subtracted from the output of gain block 372 before it is added by adder 324. Similarly, a constant may be added to the output of gain block 374 before being added by adder 330. In another example, the output of adders 324 and 330 may be scaled with additional gain blocks (forgetting factors) between said adders and multiplexers 322 and 326, respectively.

Figure 5A:
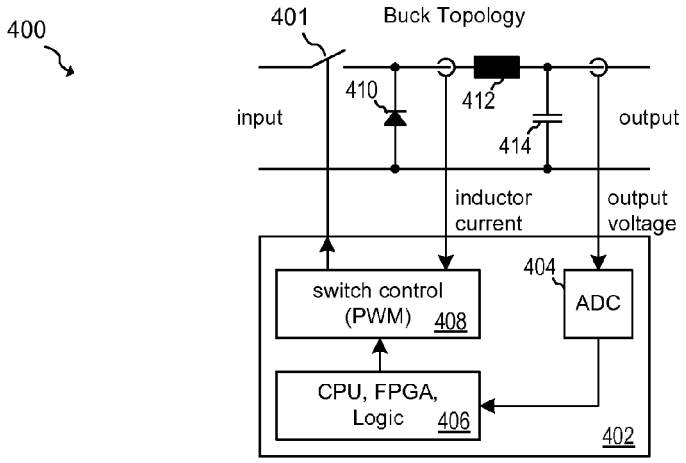
FIGS. 5*a-c* illustrate power supply topologies that employ embodiment power supply controllers.

FIG. 5*a* illustrates a buck topology switched-mode power supply 400 that incorporates controller 402 according to an embodiment of the present invention. Power supply 400 includes embodiment controller 402 coupled to switch 401, diode 410, inductor 412 and output capacitor 414. The output voltage of switched mode power supply 400 is sampled by analog-to-digital converter 404, the output of which is input to calculation block 406. Calculation block 406 may be implemented for example, using a CPU, and FPGA, custom logic or other digital circuitry. In alternative embodiments of the present invention analog-to-digital converter 404 may be omitted, and calculation block 406 may be implemented using analog components. The output of calculation block 406 is input to PWM switch control block 408 that produces a pulse width modulated signal that operates switch 401. In some embodiments, the current through inductor 412 is monitored by switch control unit 408 in order to protect the inductor against saturation or for current mode control. Operation of buck topology switched mode power supply 400 operates according to principled known in the art regarding buck topology switched mode power supplies.

Figure 5B:
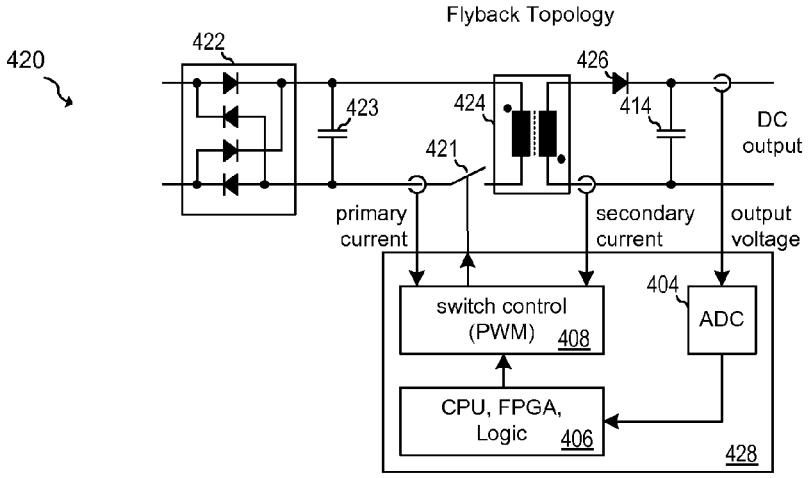

FIG. 5*b* illustrates a flyback topology switched mode power supply 420 that incorporates controller 428 in one embodiment. Switched mode power supply 420 includes rectifier 422, input capacitor 423, switch 421, transformer 424, output diode 426, as well as output capacitor 414. In an embodiment, rectifier 422 may be used to rectify an AC input signal. PWM switch control block 408 operates switch 421 according to the output of calculation block 406. The output voltage of power supply 420 may be sampled in order to control the output voltage, and the secondary current of transformer 424 may be sampled by switch control block 408 in order to control the output current. In addition to sampling the secondary current, switch control block 408 may also sample the primary current of transformer 424, for example, for use as a control input for a power factor converter (PFC) or a current mode control. Operation of flyback topology switched mode power supply 420 operates according to principled known in the art regarding flyback topology switched mode power supplies.

Figure 5C:
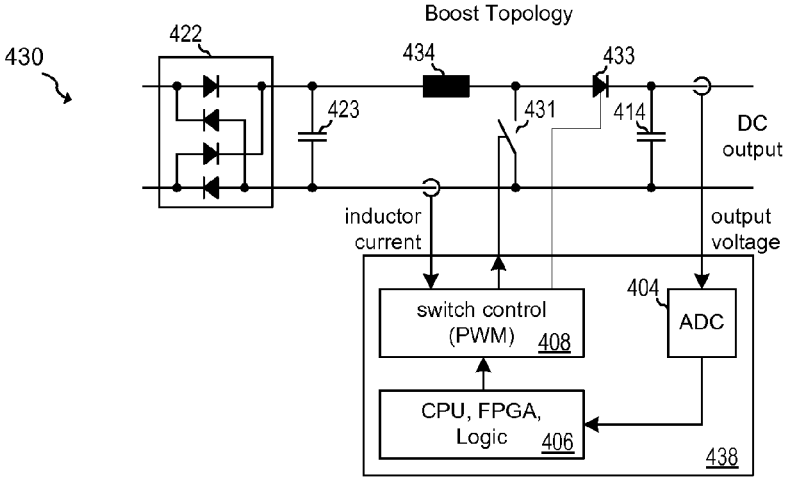

FIG. 5*c* illustrates boost topology switched mode power supply 430 that incorporates embodiment controller 438. Switched mode power supply 430 includes rectifier 422, input capacitor 423, switch 421, inductor 434, switch 431, output diode 433, as well as output capacitor 414. In an embodiment, rectifier 422 may be used to rectify an AC input signal. PWM switch control block 408 operates switch 421 according to the output of calculation block 406 and a sensed inductor current. In some embodiments, diode 433 may be implemented using a switch to perform synchronous rectification. Operation of boost topology switched mode power supply 430 operates according to principles known in the art regarding boost topology switched mode power supplies.

Figure 6:
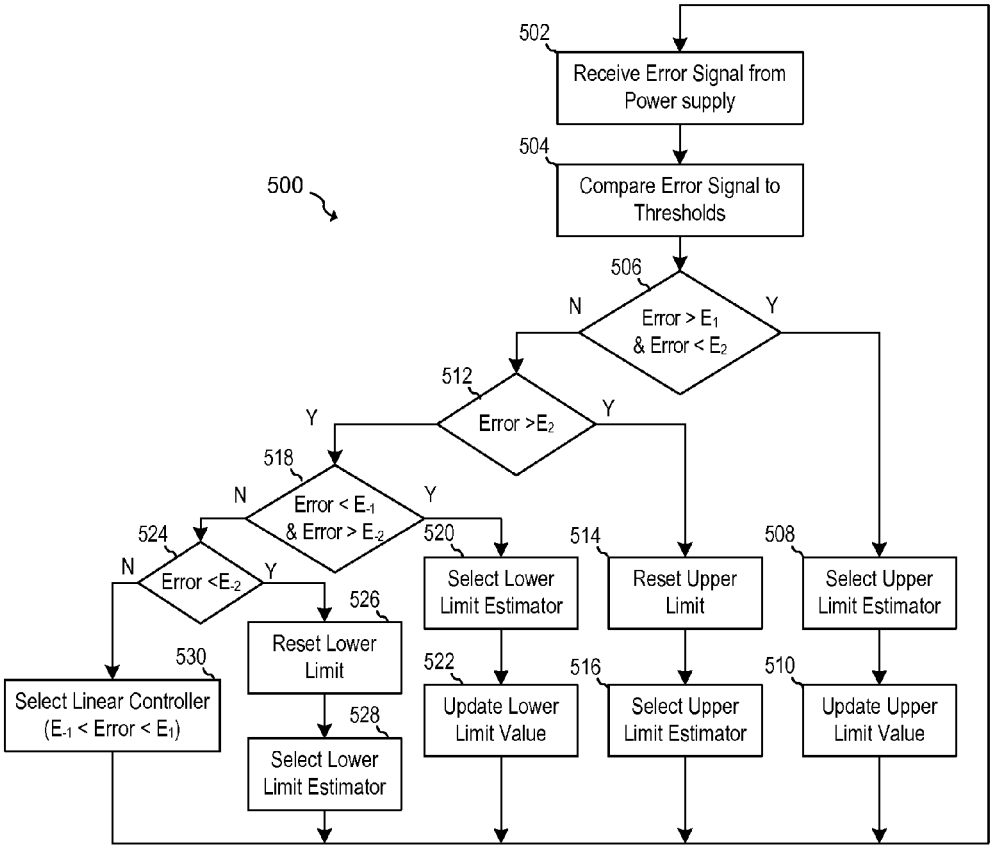
FIG. 6 illustrates a flowchart of an embodiment method.

FIG. 6 illustrates a flowchart of method 500 for an embodiment controller that may be applied, for example to embodiment controllers illustrated in FIGS. 2-4. In step 502, the controller receives an error signal from the power supply. This error signal may be, for example, the difference between a measured output voltage and reference voltage. In some cases, the measured voltage may be scaled and/or digitized. In step 504, the error signal is compared to a plurality of thresholds. While the magnitude of these thresholds may be set and implemented in varies ways and correspond to various voltage, for the sake of convenience of discussion, these thresholds will be designated as $E_{-2}$, $E_{-1}$, $E_1$, and $E_2$, where a value of zero may be associated with an error signal of zero.

If the error signal is greater than $E_1$ and less than $E_2$ (step 506), the upper limit estimator is selected (step 508) and the upper limit is updated such that the updated limit converges to the output of the linear controller (step 510); and if the error is greater than $E_2$ (step 512), then the upper limit is reset, for example, to a maximum value (step 514) and the upper limit estimator is selected (step 516). Likewise, if the error signal is less than $E_1$ and greater than $E_{-2}$ (step 518), the lower limit estimator is selected (step 520) and the lower limit is updated such that the updated limit converges to the output of the linear controller (step 522); and if the error is less than $E_{-2}$ (step 524), then the lower limit is reset, for example, to a minimum value (step 526) and the lower limit estimator is selected (step 528). If the conditions of comparison steps 506, 512, 518 and 524 are not met, signifying that the error signal is between $E_{-1}$ and $E_1$, then the linear controller is selected (step 530). It should be appreciated that in alternative embodiments, other methods and method sequences may be possible that perform embodiment algorithms. The flowchart of FIG. 6 is just one example of these.

Figure 7A:
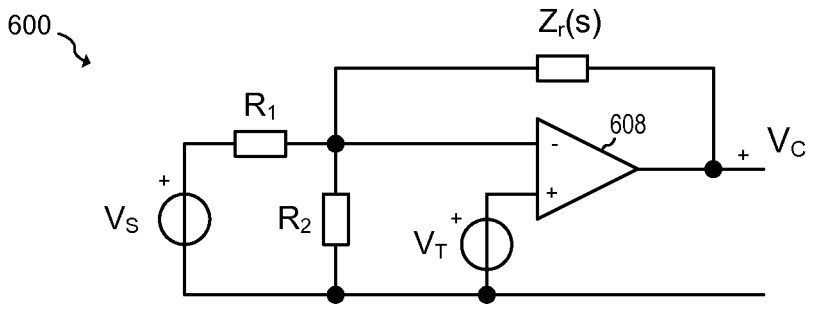
FIGS. 7*a-c* illustrate an embodiment analog controller.

FIG. 7*a* illustrates embodiment analog controller 600 that may be used, for example to implement portions of controller 306 (FIG. 3) in the analog domain. Analog controller 600 includes OPAMP 608 with impedance $Z_r(s)$ coupled in feedback between the output and negative input terminal of OPAMP 608. Voltage source $V_T$ provides a reference input to the positive input terminal of OPAMP 608, and input Voltage source $V_S$ is coupled to the negative input terminal of OPAMP 608 via resistor $R_1$. Resistor $R_2$ is coupled between the negative input terminal of OPAMP 608 and a reference node for sources $V_S$ and $V_T$ that may be ground potential in some embodiments, or another reference voltage potential in other embodiments. Output voltage $V_C$ may be expressed as:

$$V_C = V_T + \frac{Z_r(s)}{R_1}\left[\left(1 + \frac{R_1}{R}\right)V_T - V_S\right].$$

Figure 7B:
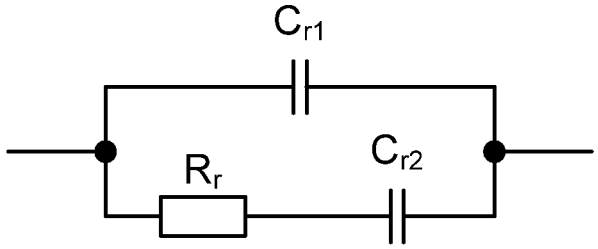

FIG. 7*b* illustrates an example implementation for impedance $Z_r$ in which capacitor $C_{r1}$ is coupled in parallel with a series combination of resistor $R_r$ and capacitor $C_{r2}$. Here, impedance $Z_r(s)$ may be expressed as:

$$Z_r(s) = \frac{1 + sR_rC_{r2}}{s(C_{r1} + C_{r2})(1 + sR_rC_{r12})},$$

where $$C_{r12} = \frac{C_{r1}C_{r2}}{C_{r1} + C_{r2}}.$$

Figure 7C:
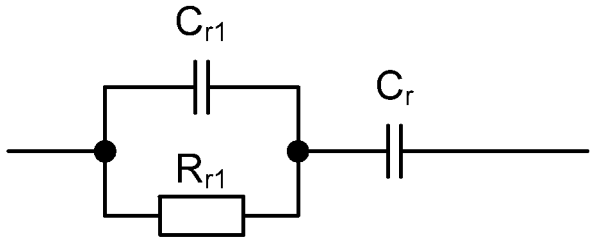

FIG. 7*c* illustrates a further example implementation for impedance $Z_r$ in which capacitor $C_r$ is coupled in series with a parallel combination of combination of resistor $R_{r1}$ and capacitor $C_{r1}$. Here, impedance $Z_r(s)$ may be expressed as:

$$Z_r(s) = \frac{1 + s(C_r + C_r)R_{r1}}{sC_r(1 + sC_{r1}R_{r1})}.$$

It should be understood that in alternative embodiments, other component arrangements may be used to implement impedance $Z_r$.

In accordance with an embodiment, a power supply controller includes an error signal input configured to be coupled to a sensing node of a power supply, a control output configured to be coupled to a switch control circuit, and a control circuit having an input coupled to the error signal input. The control circuit is configured to provide a first variable limit signal if the error signal input is in a first range, and to adjust the first variable limit signal according to the error signal input. The control circuit may be configured to transition from a bang-bang mode of operation to a linear controller mode of operation when the error signal is in a second range.

In an embodiment, the control circuit may include a linear controller, and the control circuit may be configured to provide an output of the linear controller when the error signal is in a second range. The linear controller may be further configured to continually track the error signal input, and may be further configured to set the first variable limit signal to a maximum limit value when the error signal input is in a third range. In some embodiments, the first range overlaps with the second range.

In an embodiment, the control circuit is further configured to provide a second variable limit signal when the error signal is in a fourth range, and to adjust the second variable limit signal according the error signal input. The control circuit may be further configured to set the second variable limit signal to a minimum limit value when the error signal input is in a fifth range. The first variable limit signal may be an upper limit signal, and the second variable limit signal may be a lower limit signal.

In an embodiment, the first range includes a range greater than a first threshold and less than a second threshold, the second range includes a range less than the first threshold and greater than a third threshold, the third range includes a range greater than the second threshold, the fourth range includes a range less than the third threshold and greater than a fourth threshold, and the fifth range includes a range less than the fourth threshold. In one example, the first threshold is greater than the second threshold, the second threshold is greater than the third threshold, and the third threshold is greater than the fourth threshold. In some embodiments, at least one of the first range, the second range, the third range, the fourth range, and the fifth range may overlap with another one of the first range, the second range, the third range, the fourth range and the fifth range.

In accordance with further embodiments, a power supply controller includes an upper limit estimator circuit coupled to an error signal input. The upper limit estimator circuit is configured to provide a variable upper limit signal, and to adjust the variable upper limit signal according to the error signal input. The power supply controller also includes a linear control circuit coupled to the error signal input that is configured to provide a linear control signal, and a lower limit estimator circuit coupled to the error signal input that is configured to provide a variable lower limit signal, and to adjust the variable lower limit signal according to the error signal input. Also included in the power supply controller is a range decision circuit configured to select the variable upper limit signal if the error signal is in a first range, select the linear control signal if the error signal is in a second range, and select the variable lower limit signal if the error signal is in a fourth range.

The upper limit estimator circuit may be further configured to reset the variable upper limit signal to a maximum signal level when the error signal is in a third range; and the lower limit estimator circuit may be further configured to reset the variable lower limit signal to a minimum signal level when the error signal is in a fifth range. In one embodiment, the first range includes a range greater than a first threshold and less than a second threshold, the second range includes a range less than the first threshold and greater than a third threshold, the third range includes a range greater than the second threshold, the fourth range includes a range less than the third threshold and greater than a fourth threshold, and the fifth range includes a range less than the fourth threshold. In some cases, the upper limit estimator circuit has an upper limit adjustment input coupled to the error signal input, and the lower limit estimator circuit has a lower limit adjustment input coupled to the error signal input. The upper limit adjustment input and the lower limit adjustment input may be coupled to the error signal input via at least one linear gain block and/or the upper limit adjustment input and the lower limit adjustment input may be coupled to the error signal input via the linear control circuit.

In an embodiment, the linear controller includes a PID controller coupled to the error signal input, and the upper limit adjustment input and the lower limit adjustment input are coupled to the error signal input via an output of the PID controller. Furthermore, the variable upper limit signal and the variable lower limit signal may be configured to converge toward a value of the error signal. In some embodiments, the linear control circuit is configured to continually track the error signal input even when the range decision circuit selects the variable upper limit signal, the linear control signal, and the variable lower limit signal. The linear control circuit may be implemented using digital circuitry and may be disposed on an integrated circuit.

In accordance with a further embodiment, a switched-mode power supply includes a switch control circuit, and a power supply controller having an input coupled to an output voltage of the switched-mode power supply and an output coupled to an input of the switch control circuit. The power supply controller includes a linear control circuit coupled to an error signal that is based on the output voltage of the switched-mode power supply. In an embodiments, the power supply controller is configured to output a variable upper limit signal if the error signal is above a first threshold, output a linear control signal if the error signal is below the first threshold and above a second threshold, output a variable lower limit signal if the error signal is below the second threshold, and adjust the variable upper limit signal and the variable lower limit signal to converge toward a value of the linear control signal. The linear control circuit is configured to continually track the error signal when error signal is above and below the first and second thresholds.

The power supply controller may be further configured to output a fixed upper limit signal when the error signal is above a third threshold, and output a fixed lower limit signal if the error signal is below a fourth threshold, such that the third threshold is greater than the first threshold and the fourth threshold is less than the second threshold. In some cases, the power supply controller may be further configured to reset the variable upper limit signal to a value of the fixed upper limit signal when the error signal is above the third threshold, and to reset the variable lower limit signal to a value of the fixed lower limit signal when the error signal is below the fourth threshold.

In some embodiments, the power supply also includes an inductor and a switch having an output node coupled to the inductor and an input node coupled to an output of the switch control circuit. In some embodiments, the power supply controller is implemented using digital logic, which may include a microcontroller.

In accordance with a further embodiment, a method of operating a power supply controller includes receiving an error signal from a power supply and determining a control signal, which includes determining the control signal to be a variable upper limit signal if the error signal is in a first range, determining the control signal to be a linear control signal if the error signal is in a second range, and determining the control signal to be a variable lower limit signal if the error signal is in a fourth range. The method further includes adjusting the variable upper limit signal and the variable lower limit signal to converge toward a value of the linear control signal, generating the linear control signal to continually tracking the error signal when error signal is in the second range, and generating a power supply switching signal based on the control signal.

In an embodiment, determining the control signal further includes determining the control signal to be a fixed upper limit signal when the error signal is in a third range, and determining the control signal to be a fixed lower limit signal if the error signal is in a fifth range. Determining the control signal may further include resetting the variable upper limit signal to a value of the fixed upper limit signal when the error signal is in the third range, and resetting the variable lower limit signal to a value of the fixed lower limit signal when the error signal is in the fifth range. The first range may include a range greater than a first threshold and less than a second threshold, the second range may include a range less than the first threshold and greater than a third threshold, the third range may include a range greater than the second threshold, the fourth range comprises a range less than the third threshold and greater than a fourth threshold, and the fifth range comprises a range less than the fourth threshold.

In an embodiment, at least one of the first range, the second range, the third range, the fourth range, and the fifth range overlaps with another one of the first range, the second range, the third range, the fourth range and the fifth range. Furthermore, adjusting the variable upper limit signal and the variable lower limit signal may include filtering the error signal. Advantages of embodiments include the ability for a power supply to recover quickly from large transients, while providing stable control of a power supply output during quiescent operation. A further advantage includes the ability to provide quick transient recovery and smooth steady state operation in the presence of a large capacitive load. A further advantage includes the ability for a controller to take benefits of bang-bang control during transients and after start/restart, (e.g., from system error handling or standby modes during low load) on the one hand, as well as the benefits of steady state linear feedback control on the other hand.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A power supply controller comprising:

an error signal input configured to be coupled to a sensing node of a power supply, wherein a signal of the error signal input has an error signal value;

a control output configured to be coupled to an input of a switch control circuit; and a control circuit comprising a linear controller having an input coupled to the error signal input, and an output coupled to the control output, the control circuit configured to provide a first variable limit signal to the control output when the error signal value is in a first range, to provide an output of the linear controller to the control output when the error signal value is in a second range, and to adjust the first variable limit signal according to the error signal value.

2. The power supply controller of claim 1, wherein the linear controller is configured to continually track the error signal value.

3. The power supply controller of claim 1, wherein the first range overlaps with the second range.

4. The power supply controller of claim 1, wherein the control circuit is further configured to set the first variable limit signal to a maximum limit value when the error signal value is in a third range.

5. The power supply controller of claim 4, wherein:

the control circuit is further configured to provide a second variable limit signal when the error signal value is in a fourth range, and to adjust the second variable limit signal according the error signal value.

6. The power supply controller of claim 5, wherein the control circuit is further configured to set the second variable limit signal to a minimum limit value when the error signal value is in a fifth range.

7. The power supply controller of claim 6, wherein the first variable limit signal is an upper limit signal, and the second variable limit signal is a lower limit signal.

8. The power supply controller of claim 6, wherein:

the first range comprises a range greater than a first threshold and less than a second threshold;

the second range comprises a range less than the first threshold and greater than a third threshold;

the third range comprises a range greater than the second threshold; and the fourth range comprises a range less than the third threshold and greater than a fourth threshold; and the fifth range comprises a range less than the fourth threshold.

9. The power supply controller of claim 8, wherein:

the first threshold is greater than the second threshold;

the second threshold is greater than the third threshold; and the third threshold is greater than the fourth threshold.

10. The power supply controller of claim 8, wherein at least one of the first range, the second range, the third range, the fourth range, and the fifth range overlaps with another one of the first range, the second range, the third range, the fourth range and the fifth range.

11. The power supply controller of claim 1, wherein the control circuit is configured to transition from a bang-bang mode of operation to a linear controller mode of operation when the error signal value enters the second range.

12. The power supply controller of claim 1, further comprising the switch control circuit, wherein the input of the switch control circuit is coupled to the control output, and the switch control circuit is configured to produce a pulse modulated switch control signal.

13. A power supply controller comprising:

an upper limit estimator circuit coupled to an error signal input, wherein the error signal input is configured to be coupled to a sensing node of a power supply, a signal of the error signal input has an error signal value, and the upper limit estimator circuit is configured to provide a variable upper limit signal, and to adjust the variable upper limit signal according to the error signal value;

a linear control circuit coupled to the error signal input, wherein the linear control circuit is configured to provide a linear control signal;

a lower limit estimator circuit coupled to the error signal input, wherein the lower limit estimator circuit is configured to provide a variable lower limit signal, and to adjust the variable lower limit signal according to the error signal value;

a range decision circuit configured to:

select the variable upper limit signal if the error signal value is in a first range, select the linear control signal if the error signal value is in a second range, and select the variable lower limit signal if the error signal value is in a fourth range; and a multiplexer configured to output the signal selected by the range decision circuit to an output circuit of the power supply, wherein the signal selected by the range decision circuit affects a signal of the sensing node of the power supply.

14. The power supply controller of claim 13, wherein:

the upper limit estimator circuit is further configured to reset the variable upper limit signal to a maximum signal level when the error signal value is in a third range; and the lower limit estimator circuit is further configured to reset the variable lower limit signal to a minimum signal level when the error signal value is in a fifth range.

15. The power supply controller of claim 14, wherein:

the first range comprises a range greater than a first threshold and less than a second threshold;

the second range comprises a range less than the first threshold and greater than a third threshold;

the third range comprises a range greater than the second threshold; and the fourth range comprises a range less than the third threshold and greater than a fourth threshold; and the fifth range comprises a range less than the fourth threshold.

16. The power supply controller of claim 13, wherein:

the upper limit estimator circuit comprises an upper limit adjustment input coupled to the error signal input; and the lower limit estimator circuit comprises a lower limit adjustment input coupled to the error signal input.

17. The power supply controller of claim 16, further wherein the upper limit adjustment input and the lower limit adjustment input are coupled to the error signal input via at least one linear gain block.

18. The power supply controller of claim 16, wherein the upper limit adjustment input and the lower limit adjustment input are coupled to the error signal input via the linear control circuit.

19. The power supply controller of claim 18, wherein:

the linear control circuit comprises a PID controller coupled to the error signal input; and the upper limit adjustment input and the lower limit adjustment input are coupled to the error signal input via an output of the PID controller.

20. The power supply controller of claim 13, wherein the variable upper limit signal and the variable lower limit signal are configured to converge toward the error signal value.

21. The power supply controller of claim 13, wherein the linear control circuit is configured to continually track the error signal value even when the range decision circuit selects the variable upper limit signal, the linear control signal, and the variable lower limit signal.

22. The power supply controller of claim 21, wherein the linear control circuit is implemented using digital circuitry.

23. The power supply controller of claim 13, wherein the power supply controller is disposed on an integrated circuit.

24. A switched-mode power supply comprising:

a switch control circuit; and a power supply controller having an input coupled to an output voltage of the switched-mode power supply and an output coupled to an input of the switch control circuit, wherein the power supply controller comprises a linear control circuit receiving an error signal that is based on the output voltage of the switched-mode power supply, and the power supply controller is configured to output a variable upper limit signal at the output of the power supply controller if the error signal is above a first threshold, output a linear control signal at the output of the power supply controller if the error signal is below the first threshold and above a second threshold, output a variable lower limit signal at the output of the power supply controller if the error signal is below the second threshold, and adjust the variable upper limit signal and the variable lower limit signal to converge toward a value of the linear control signal, wherein the linear control circuit is configured to continually track the error signal when error signal is above and below the first and second thresholds.

25. The switched-mode power supply of claim 24, wherein the power supply controller is further configured to output a fixed upper limit signal when the error signal is above a third threshold, and output a fixed lower limit signal if the error signal is below a fourth threshold, wherein the third threshold is greater than the first threshold and the fourth threshold is less than the second threshold.

26. The switched-mode power supply of claim 25, wherein the power supply controller is further configured to reset the variable upper limit signal to a value of the fixed upper limit signal when the error signal is above the third threshold, and to reset the variable lower limit signal to a value of the fixed lower limit signal when the error signal is below the fourth threshold.

27. The switched-mode power supply of claim 24, further comprising:

an inductor; and a switch having an output node coupled to the inductor and an input node coupled to an output of the switch control circuit.

28. The switched-mode power supply of claim 24, wherein the power supply controller is implemented using digital logic.

29. The switched-mode power supply of claim 28, wherein the digital logic comprises a microcontroller.

30. A method of operating a power supply controller, the method comprising:

receiving an error signal from a power supply, wherein the error signal is based on a difference between a reference signal and a measured signal of the power supply;

determining a control signal comprising determining the control signal to be a variable upper limit signal if the error signal is in a first range, determining the control signal to be a linear control signal if the error signal is in a second range, and determining the control signal to be a variable lower limit signal if the error signal is in a fourth range;

adjusting the variable upper limit signal and the variable lower limit signal to converge toward a value of the linear control signal;

generating the linear control signal to continually tracking the error signal when error signal is in the second range; and generating a power supply switching signal based on the control signal.

31. The method of claim 30, wherein the determining the control signal further comprises:

determining the control signal to be a fixed upper limit signal when the error signal is in a third range; and determining the control signal to be a fixed lower limit signal if the error signal is in a fifth range.

32. The method of claim 31, wherein the determining the control signal further comprises:

resetting the variable upper limit signal to a value of the fixed upper limit signal when the error signal is in the third range, and resetting the variable lower limit signal to a value of the fixed lower limit signal when the error signal is in the fifth range.

33. The method of claim 32, wherein:

the first range comprises a range greater than a first threshold and less than a second threshold;

the second range comprises a range less than the first threshold and greater than a third threshold;

the third range comprises a range greater than the second threshold;

the fourth range comprises a range less than the third threshold and greater than a fourth threshold; and the fifth range comprises a range less than the fourth threshold.

34. The method of claim 32, wherein at least one of the first range, the second range, the third range, the fourth range, and the fifth range overlaps with another one of the first range, the second range, the third range, the fourth range and the fifth range.

35. The method of claim 30, wherein the adjusting the variable upper limit signal and the variable lower limit signal comprises filtering the error signal.

* * * * *